US006134915A

United States Patent [19]

Denzau et al.

[11] Patent Number: 6,134,915

[45] Date of Patent: Oct. 24, 2000

[54] DISTILLATION COLUMN ARRANGEMENT FOR AIR SEPARATION PLANT

[75] Inventors: Arthur R. Denzau, Piscataway, N.J.; Andrew B. McKenzie, New York, N.Y.

[73] Assignee: The BOC Group, Inc., New Providence, N.J.

[21] Appl. No.: 09/281,458

[22] Filed: Mar. 30, 1999

[51] Int. Cl.[7] ..... F25J 1/00

[52] U.S. Cl. ..... 62/643; 62/905; 202/158

[58] Field of Search ..... 62/643, 905, 906, 62/907; 202/158

[56] References Cited

U.S. PATENT DOCUMENTS

| | | | |
|---|---|---|---|
| 4,038,060 | 7/1977 | Kamiya et al. | 62/907 |
| 5,412,954 | 5/1995 | Grenier | 62/907 |
| 5,463,871 | 11/1995 | Cheung . | |
| 5,617,742 | 4/1997 | Toppel | 62/902 |
| 5,735,141 | 4/1998 | Whitlock | 62/905 |

*Primary Examiner*—Ronald Capossela
*Attorney, Agent, or Firm*—Salvotore P. Pace

[57] ABSTRACT

A packaged column arrangement for an air separation plant in which a cold box is filled with an insulating material and higher and lower pressure columns are mounted within the cold box. The lower pressure column has an intermediate reboiler connected to the higher pressure column for condensing nitrogen enriched tower overhead formed within the higher pressure column in order to produce reflux for the columns. The higher and lower pressure columns are positioned within the cold box so that the higher and lower pressure columns are in a sufficiently staggered relationship that the reflux stream to the higher pressure column flows under gravitational influence. Moreover, auxiliary equipment such as vaporizer and subcooling heat exchange units can be conveniently connected to the columns when themselves may be mounted within the cold box by a simple I-beam mounting.

4 Claims, 2 Drawing Sheets

DISTILLATION COLUMN ARRANGEMENT FOR AIR SEPARATION PLANT

BACKGROUND OF THE INVENTION

The present invention relates to a packaged column arrangement for an air separation plant of the type having higher and lower pressure columns. More particularly, the present invention relates to such a packaged column arrangement in which an intermediate reboiler is provided in the lower pressure column to condense tower overhead of the higher pressure column, thereby to provide reflux for the both the higher and lower pressure columns. Even more particularly, the present invention relates to such a packaged column arrangement in which the higher and lower pressure columns are positioned within a cold box so that the higher and lower pressure columns are in a sufficiently staggered relationship that the reflux stream flows under the influence of gravity into the higher pressure column.

There are a variety of plant designs and cycles by which air is separated into oxygen and nitrogen. In a common type of air separation plant, air is partially or fully condensed within a bottom reboiler of a lower pressure column. The partially or fully condensed air is then rectified in the bottom of a higher pressure column. The rectification of the air produces a nitrogen rich tower overhead and an oxygen rich column bottoms. Reflux for both the higher and lower pressure columns is produced by condensing a stream of the nitrogen rich tower overhead in an intermediate reboiler positioned within the lower pressure column.

An example of such a plant may be found in U.S. Pat. No. 5,463,871 in which the higher pressure column is placed below a section of the lower pressure column containing the intermediate reboiler. The other section of the lower pressure column, containing the lower reboiler, serves to condense or partially condense the air. Since the intermediate reboiler is located directly above the higher pressure column, reflux flows under gravitational influenced into the higher pressure column.

The distillation column arrangement of U.S. Pat. No. 5,463,871 is mounted within an insulated cold box structure. The cold box for such a plant must have a sufficient height to accommodate the higher pressure column and the lower pressure column section located above the higher pressure column. As is well known in the art, the higher the cold box, the more expense the plant because more materials are used in its fabrication. In addition, the mounting of a three column arrangement is normally effectuated by separate mountings which add to the complexity of the cold box.

As will be discussed, the present invention provides a distillation column arrangement having an intermediate reboiler in which the height of the cold box is inherently less than the prior art and also, the column mounting is less complicated.

SUMMARY OF THE INVENTION

The present invention provides a packaged column arrangement for an air separation plant. The package column arrangement comprises a cold box filled with an insulating material and higher and lower pressure columns. The lower pressure column has an intermediate reboiler connected to the higher pressure column for condensing nitrogen enriched tower overhead formed there within. This produces a reflux stream that is reintroduced into the higher pressure column. The higher and lower pressure columns are positioned within the cold box in a sufficiently staggered relationship that the reflux stream flows by gravity back into the higher pressure column.

Since the lower pressure column is not split into two parts, the cold box height is less than that of the prior art. Moreover, the resultant two, instead of three columns, can be mounted on a common set of mountings.

A further advantage is that auxiliary equipment may be conveniently attached to the columns themselves to also simplify the requisite mounting arrangement within the cold box. In this regard, a vaporizer can be positioned above and connect to the higher pressure column and a subcooling heat exchanger positioned below and connected to the lower pressure column. The higher and lower pressure columns may be supported within said cold box by a single support network supporting both the higher and lower pressure columns and the subcooling heat exchanger can be attached to and depend from the lower pressure column. A pump for pumping liquid oxygen to said vaporizer and a turbine can be mounted within the cold box at the bottom thereof.

As is apparent, all the major components that relate to the distillation columns can be connected to the distillation column with the distillation columns connected to the cold box in a simple mounting. A further advantage of such a compact arrangement is that the columns and associated equipment may be erected with a minimum of problems associated with the leveling of each of the components.

BRIEF DESCRIPTION OF THE DRAWINGS

While the specification concludes with claims distinctly pointing out the subject matter that Applicants regard as their invention it is believed that the invention will be better understood when taken in connection with the accompanying drawings in which:

DETAILED DESCRIPTION

Figure 1:
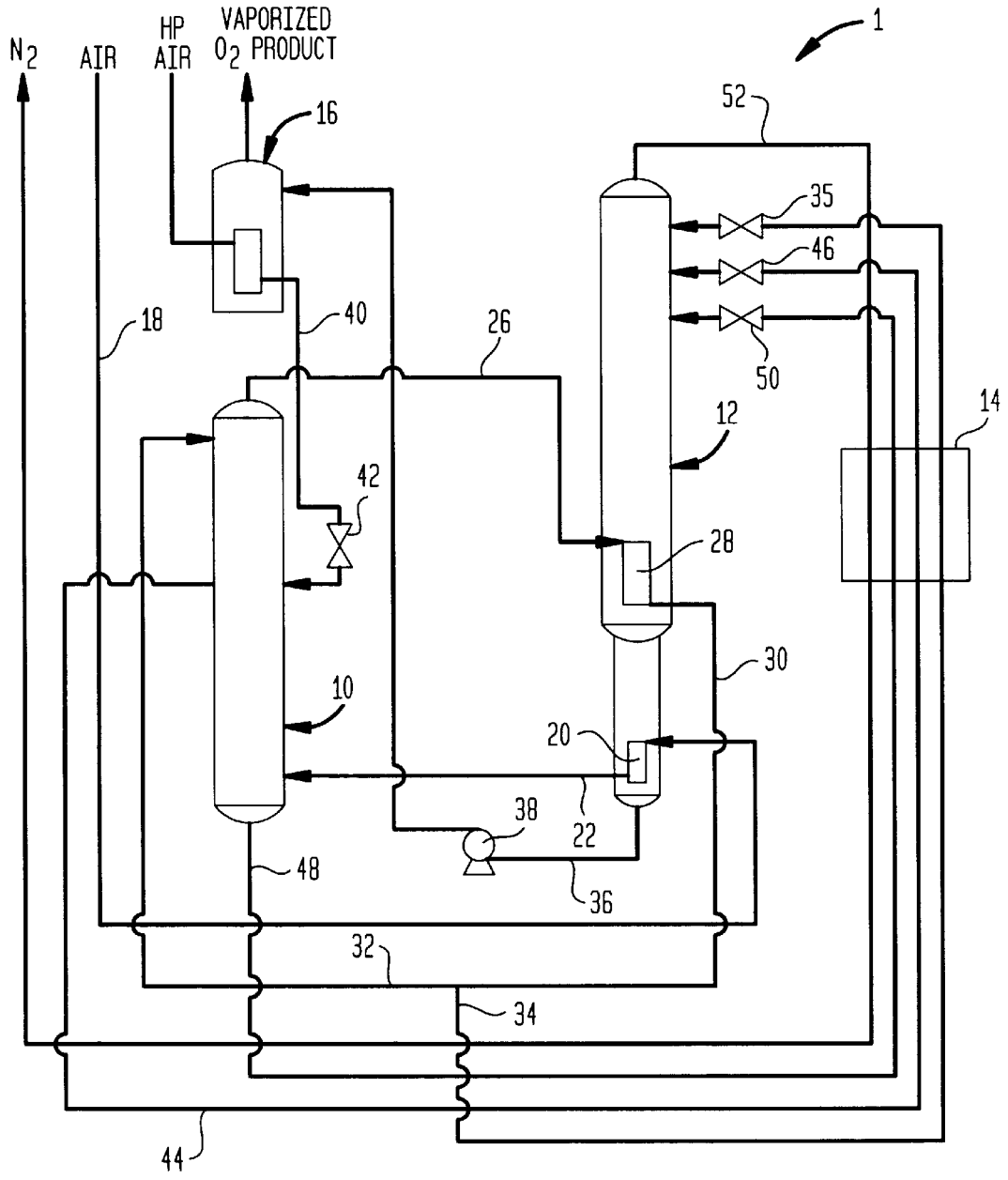
FIG. 1 is a schematic view of an air separation plant.
Figure 2:
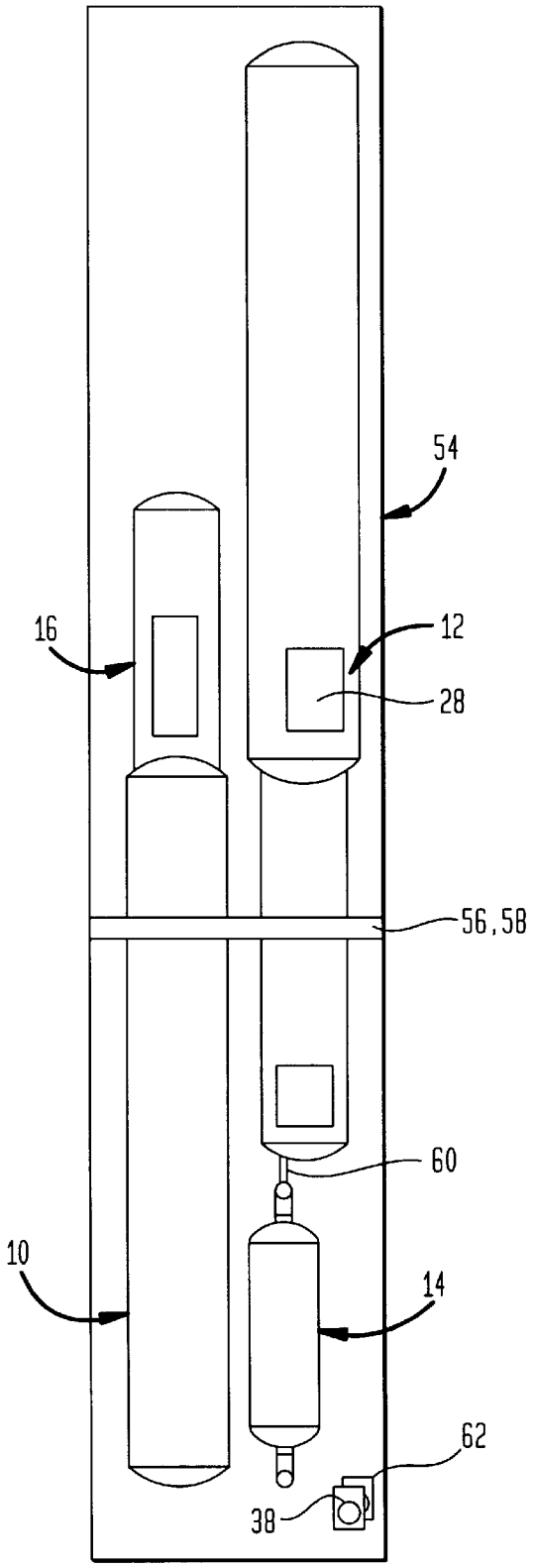
FIG. 2 is cold box arrangement for such air separation in accordance with the present invention.

With reference to FIG. 1, an air separation plant 1 is illustrated. Air separation plant 1 is provided with a higher pressure column 10, a lower pressure column 12 a subcooling heat exchanger unit 14 and an air vaporizer 16 to vaporize the air. Not shown in air separation plant 1 are items that are external to the cold box such as main air compressor, the pre-purification unit and the main heat exchanger. Additionally, a turboexpander used to provide refrigeration which not shown in FIG. 1, is shown in FIG. 2.

Air stream 18 after having been cooled to around its dewpoint is partially condensed within bottom reboiler 20 of lower pressure column 12. The resultant stream 22 is introduced into higher pressure column 10 for rectification.

The rectification of the air produces a nitrogen rich tower overhead and an oxygen enriched liquid column bottoms. The nitrogen rich tower overhead is extracted as a stream 26 and is then condensed within an intermediate reboiler 28. The resultant nitrogen condensed stream 30 is divided into reflux streams 32 and 34. Reflux stream 32 is introduced into the top of higher pressure column 10 and reflux stream 34 after having been subcooled within subcooling unit 14 and expanded through an expansion valve 35 is introduced into the top of lower pressure column 12.

The air is further refined within lower pressure column 12 to produce an oxygen rich column bottoms which is extracted as a product stream 36. Product stream 36 is pressurized by a pump 38 and then vaporized within vaporizer 16 to produce to a vaporized oxygen product. This vaporization occurs through heat exchange with higher pressure air that is liquefied to produce a liquid air stream 40. Liquid air stream 40 after having been expanded by expansion valve 42 is introduced into an intermediate location of higher pressure column 10. Part of the liquid air stream is removed as an intermediate stream 44 which after having been subcooled within subcooling unit 14 is expanded across an expansion valve 46.

Crude liquid oxygen forms as a column bottoms within higher pressure column 10 is extracted as a crude liquid oxygen stream 48 which also is subcooled within subcooling unit 14 and expanded across a valve 50 prior to its introduction into lower pressure column 12 for further refinement. Nitrogen tower overhead stream 52 provides the refrigeration duty for subcooling unit 14.

With reference to FIG. 2, a cold box 54 is illustrated that mounts to lower pressure column 12 and higher pressure column 10 within a staggered relationship by two I-beams 56, 58 of which only eye beam 56 is visible in the drawings. Cold box 12 is filled with an insulating material not shown in the drawings. Additionally, the piping used to conduct the various streams mentioned in connection with FIG. 1 are also not shown.

Higher and lower pressure columns 10 and 12 are positioned within cold box 54 in a staggered relationship so that intermediate reboiler 28 will be positioned slightly above higher pressure column 10 so that the resultant reflux stream 32 can flow by gravity back into higher pressure column 10. Preferably, vaporizer 16 is connected to the top of higher pressure column 10. Subcooling heat exchange unit 14 is preferably hung from the bottom of lower pressure column 12 in a depending relationship by way of a mounting bar 60. As may be appreciated, vaporizer 16 and subcooling heat exchange unit 14 could be connected to cold box 54 for mounting purposes. However, such mounting would add to the complexity involved in constructing cold box 54 and its internals. Pump 38 and a turbine 62 (the turboexpander used to generate refrigeration) may also be mounted within the cold box near the subcooling heat exchanger unit 14.

As will occur to those skilled in the art, numerous changes, additions and omissions may be made without departing from the spirit and scope of the present invention.

We claim:

1. A packaged column arrangement for an air separation plant comprising an insulated cold box having therein a higher pressure column and a lower pressure column in fluid communication, said lower pressure column containing an intermediate reboiler in fluid communication with said higher pressure column for condensing the nitrogen-enriched tower formed in the higher pressure column during operation thereof to form a reflux stream for re-introduction into said higher pressure column, said lower pressure column and said higher pressure column being positioned within said cold box such that said intermediate reboiler is above said higher pressure column so that said reflux stream flows by gravitational flow into said higher pressure column.

2. The packaged column arrangement of claim 1, further comprising a vaporizer positioned above and in fluid communication with said higher pressure column and a subcooling heat exchanger positioned below and in fluid communication with said lower pressure column.

3. The packaged column arrangement of claim 1 wherein said higher and lower pressure column are supported within said cold box by a single support structure, said subcooling heat exchanger is connected to and depends from said lower pressure column and said vaporizer is connected to the top of said higher pressure column.

4. The packaged column arrangement of claim 2 or claim 3, wherein a pump for pumping liquid oxygen to said vaporizer and a turbine are mounted within said cold box at the bottom thereof.

* * * * *